US011105503B2

(12) United States Patent
Op De Beeck

(10) Patent No.: US 11,105,503 B2
(45) Date of Patent: Aug. 31, 2021

(54) COMBUSTION BY CONTROLLED IONISATION

(71) Applicant: Op De Beeck, Mettet (BE)

(72) Inventor: Op De Beeck, Mettet (BE)

( * ) Notice: Subject to any disclaimer, the term of this patent is extended or adjusted under 35 U.S.C. 154(b) by 305 days.

(21) Appl. No.: 15/844,560

(22) Filed: Feb. 26, 2018

(65) Prior Publication Data

US 2019/0264907 A1 Aug. 29, 2019

(51) Int. Cl.

| | |
|---|---|
| ***F23C 99/00*** | (2006.01) |
| ***F23B 30/00*** | (2006.01) |
| ***F23B 99/00*** | (2006.01) |

(52) U.S. Cl.

CPC ..... *F23C 99/001* (2013.01); *F23B 7/00* (2013.01); *F23B 99/00* (2013.01); *F23B 2900/00006* (2013.01)

(58) Field of Classification Search

CPC ..... F23C 99/001; F23B 7/00; F23B 99/00; F23B 2900/00006

USPC ..... 431/253, 8, 350

See application file for complete search history.

(56) References Cited

U.S. PATENT DOCUMENTS

| | | | | | |
|---|---|---|---|---|---|
| 1,994,443 | A * | 3/1935 | Bailey | F23D 1/06 | 110/347 |
| 2,604,936 | A * | 7/1952 | Kaehni | G05D 23/1919 | 432/9 |
| 4,025,286 | A * | 5/1977 | Husselmann | F24H 9/1836 | 431/171 |
| 4,493,638 | A * | 1/1985 | Scammell | F23G 7/08 | 431/171 |
| 4,616,994 | A * | 10/1986 | Tomlinson | F23D 14/105 | 431/347 |
| 4,934,927 | A * | 6/1990 | Swiatosz | F23D 14/70 | 431/170 |
| 5,015,173 | A * | 5/1991 | Fullemann | F23D 11/008 | 431/116 |
| 5,154,597 | A * | 10/1992 | Fullemann | F23D 11/005 | 431/116 |
| 2004/0018460 | A1* | 1/2004 | Korwin | F23G 7/065 | 431/5 |
| 2016/0123582 | A1* | 5/2016 | Rangwala | F23D 5/123 | 588/320 |
| 2017/0292699 | A1* | 10/2017 | Lee | B01J 8/44 | |
| 2018/0149356 | A1* | 5/2018 | Arava | F23G 5/008 | |

* cited by examiner

*Primary Examiner* — Steven B McAllister
*Assistant Examiner* — Daniel E. Namay

(57) ABSTRACT

This invention is intended to produce more energy during the combustion of fuels (solid, liquid or gas). This is achieved by separating the electrons and the cations which are produced at the very beginning of the phenomenon of combustion. This way of making conducts to more violent shocks between the cations (C+++; H+) and the anions (O−−); thus more energy.

1 Claim, 6 Drawing Sheets

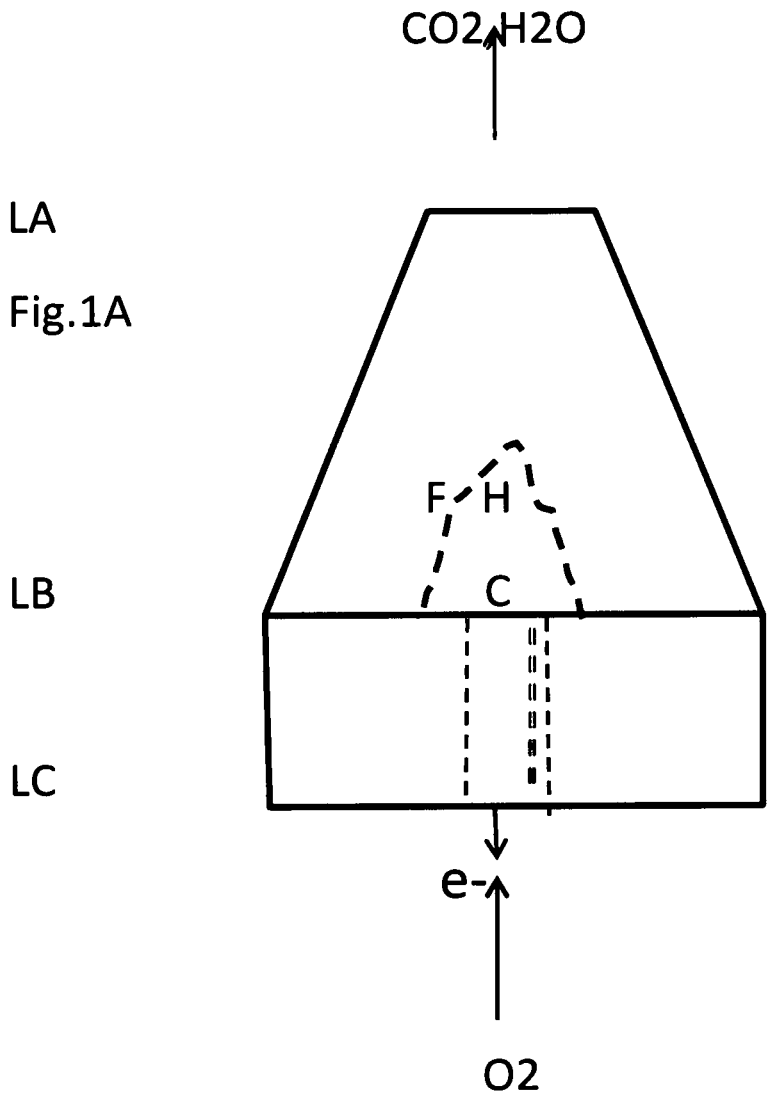
Fig.1A
Fig.1B
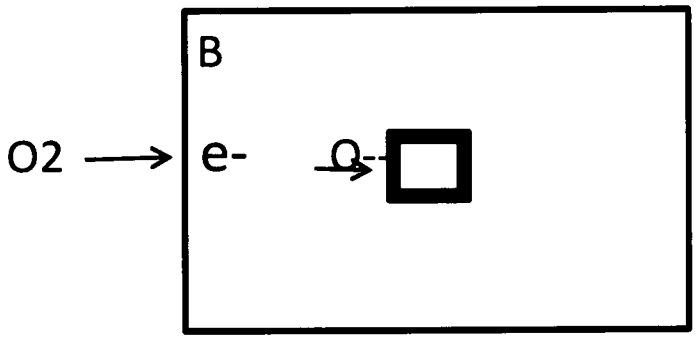

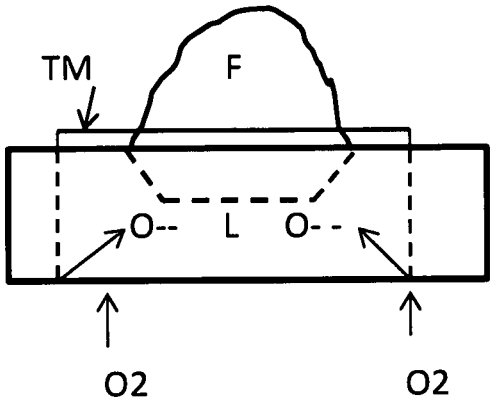
Fig.4A
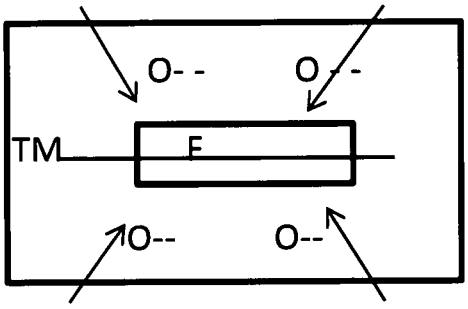
Fig.4B
Fig.4C
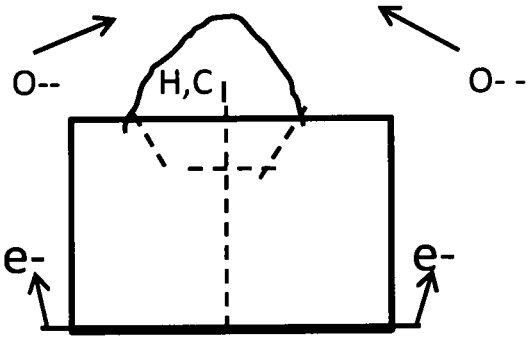

COMBUSTION BY CONTROLLED IONISATION

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO SEQUENCE LISTING, A TABLE, OR A COMPUTER PROGRAM LISTING COMPACT DISC APPENDIX

Not applicable.

BACKGROUND OF THE INVENTION

Not applicable.

BRIEF SUMMARY OF THE INVENTION

The invention described in this patent provides more energy for a given amount of fuel (solid or liquid) (+/−50% more observed in certain cases compared with the traditional methods).

For this, we use metallic pieces embedded in the combustion area. The upper side of the metal parts is near the flames and thus is hot. The lower side of the same metal parts is at the air inlet and thus is cold. This difference of temperature inside the metal part creates an electric field in the part. The hot side is positive and the cola side is negative. The purpose is to better use, better regulate the production of ions and electrons naturally produced during the first step of combustion. The electrons are caught by the positive upper side of the parts and elected by Peak effect on the air inlet.

BRIEF DESCRIPTION OF THE SEVERAL VIEWS OF THE DRAWING

FIG. 1A and FIG. 1B:

An aluminum cone wraps the flame. The cone attracts the electrons and push pushes the cations (carbon, hydrogen) to the bottom side away. At the level LC, the electrons are ejected from the cone on the entering oxygen (O−−). This O−− passes through the brick and arrives at the bottom of the flame. Separation is: electrons to the top and cations to the bottom where they collide the entering O−−.

FIG. 1A: side view of the device. The aluminum cone stands on a brick containing holes for the entering O−−

FIG. 1B: bottom view of the device. The oxygen arrives at the bottom, catches the electrons; becomes O—and goes to the burning carbon.

Figure 2A:
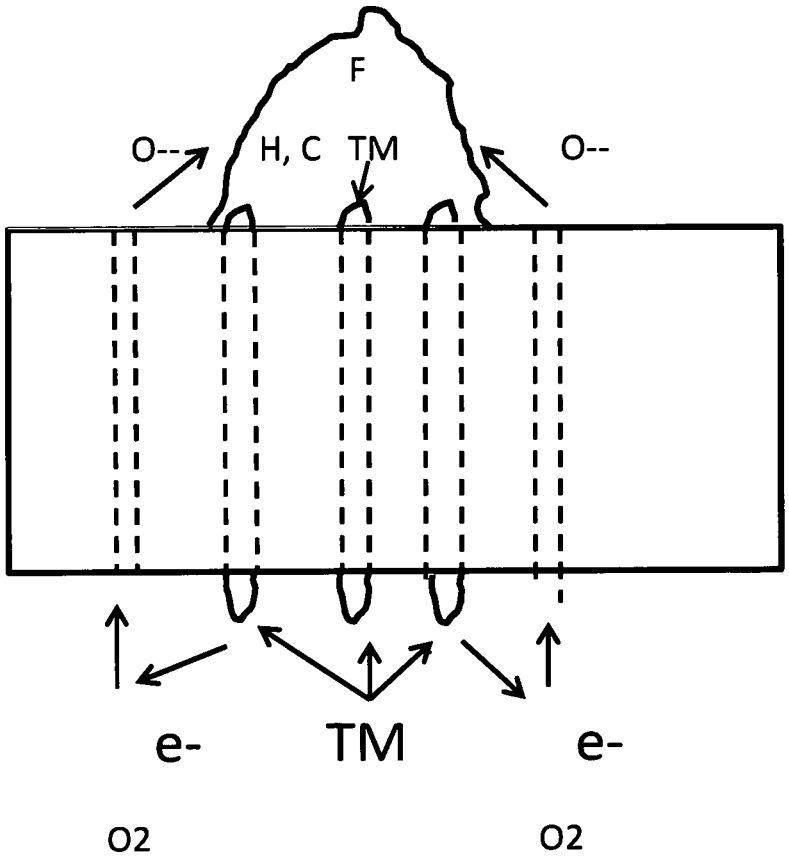
Figure 2B:
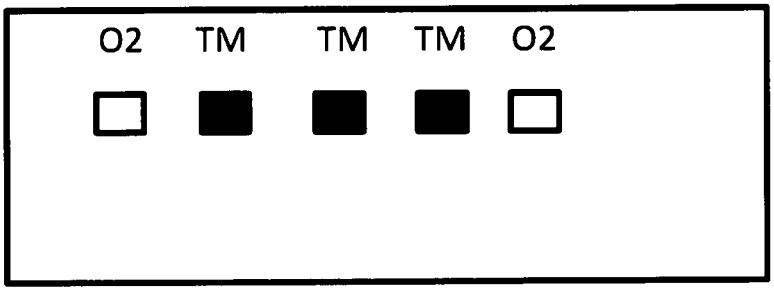

FIG. 2A and FIG. 2B

The brick which supports the combustion is pierced by holes. Some of the holes are fit with metallic pieces (TM on the drawing). There top sides are near the flames thus hot and positive, thus attracting the electrons produced by the incandescent fuel. These electrons move to the cold bottom side where mare ejected on the entering oxygen.

FIG. 2A: side view of the device. Here we see the metallic pieces which penetrates through the brick (from the combustion area to the bottom of the brick). These metallic pieces catch the electrons near the combustion area and reject them at the bottom where the oxygen enters. The entering oxygen catches the electrons before entering the brick.

FIG. 2B: bottom view of the device. In black the metallic ends near the holes for the entering O−−.

Figure 3A:
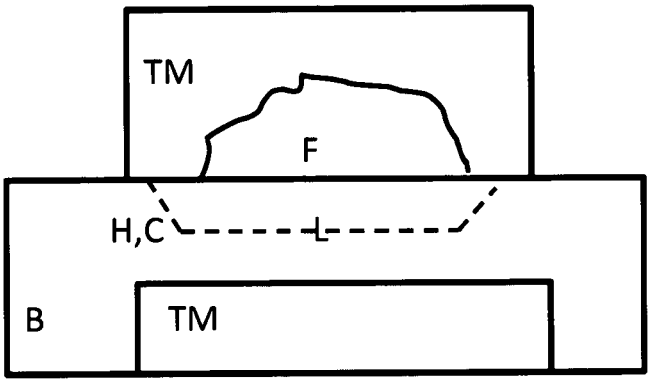
Figure 3B:
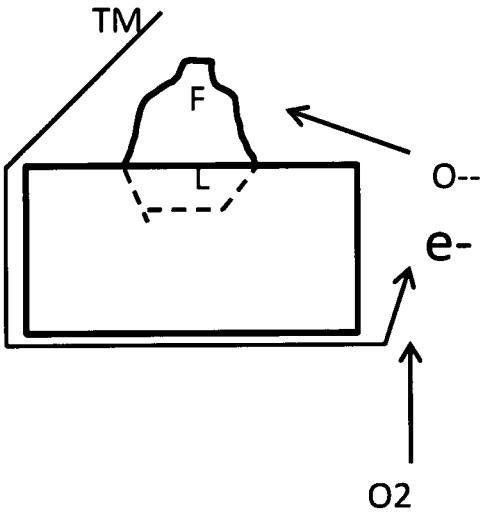

FIG. 3A and FIG. 3B:

A design for liquid fuel with a half cone but the principles are the same. Here, the aluminum wraps the brick and passes below the brick. At the cold side of the aluminum, where you find e− and O−− on the drawing, the electrons are ejected on the entering oxygen. The hot part of aluminum which is positive, is pulling the cations (C++++, H+) towards the arriving O—.

FIG. 3A side view. Length direction of the brick. TM is the aluminum or metallic plate wrapping the brick. The top part of the TM plate is above the flame and catches the electrons emitted by the combustion. Under the flame is the liquid fuel. FIG. 3B: side view. (Width direction of the brick). Here, we see the metallic piece "TM" wrapping the brick and the flame. At the extremity of the plate (bottom side of the brick, the electrons are ejected on the entering O2 which becomes O−−.

FIG. 4A, FIG. 4B and FIG. 4C:

Here, the metallic part is a bar "TM" passing through the flames (horizontally) and then, through the brick. At the bottom of the brick, the cold extremity of the bar, ejects the electrons caught near the flames.

FIG. 4A: side view. (Length direction of the brick).

FIG. 4B: top view.

FIG. 4C: side view. (Width direction of the brick). Here, we see the cold extremity of the bar where the electrons (e−) are ejected. Oxygen becomes O−− and goes up to the flames.

Figure 5A:
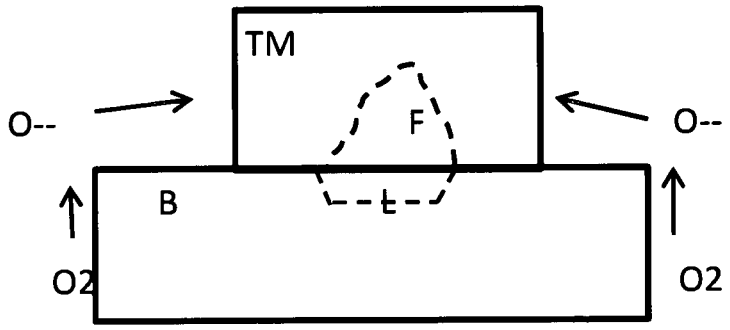
Figure 5B:
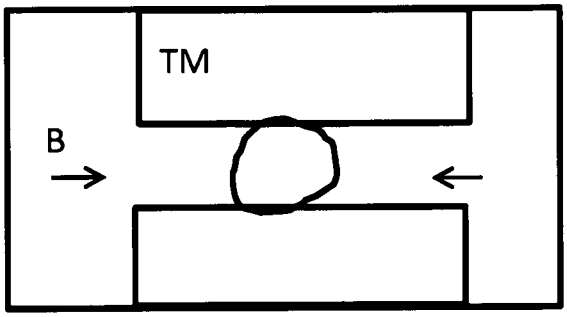
Figure 5C:
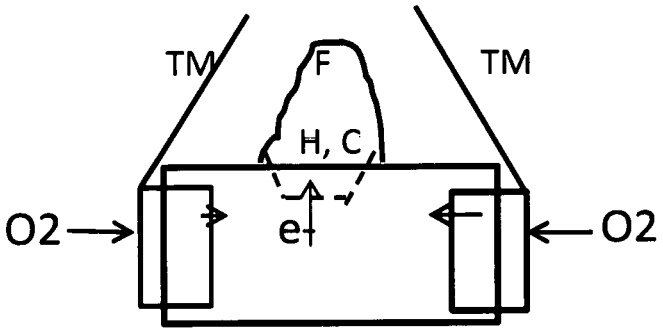

FIG. 5A, FIG. 5B, and FIG. 5C:

A variant for liquid fuels with twin aluminum sheets wrapping the flames. Here, the caught electrons are ejected on the bottom sides of the brick.

FIG. 5A: side view. (Length direction of the brick).

FIG. 5B: top view of the device.

FIG. 5C: side view. (Width direction of the brick). Here, we see the cold extremity of the plates where the electrons (e−) are ejected. Oxygen becomes O−− and goes up to the flames.

Figure 6:
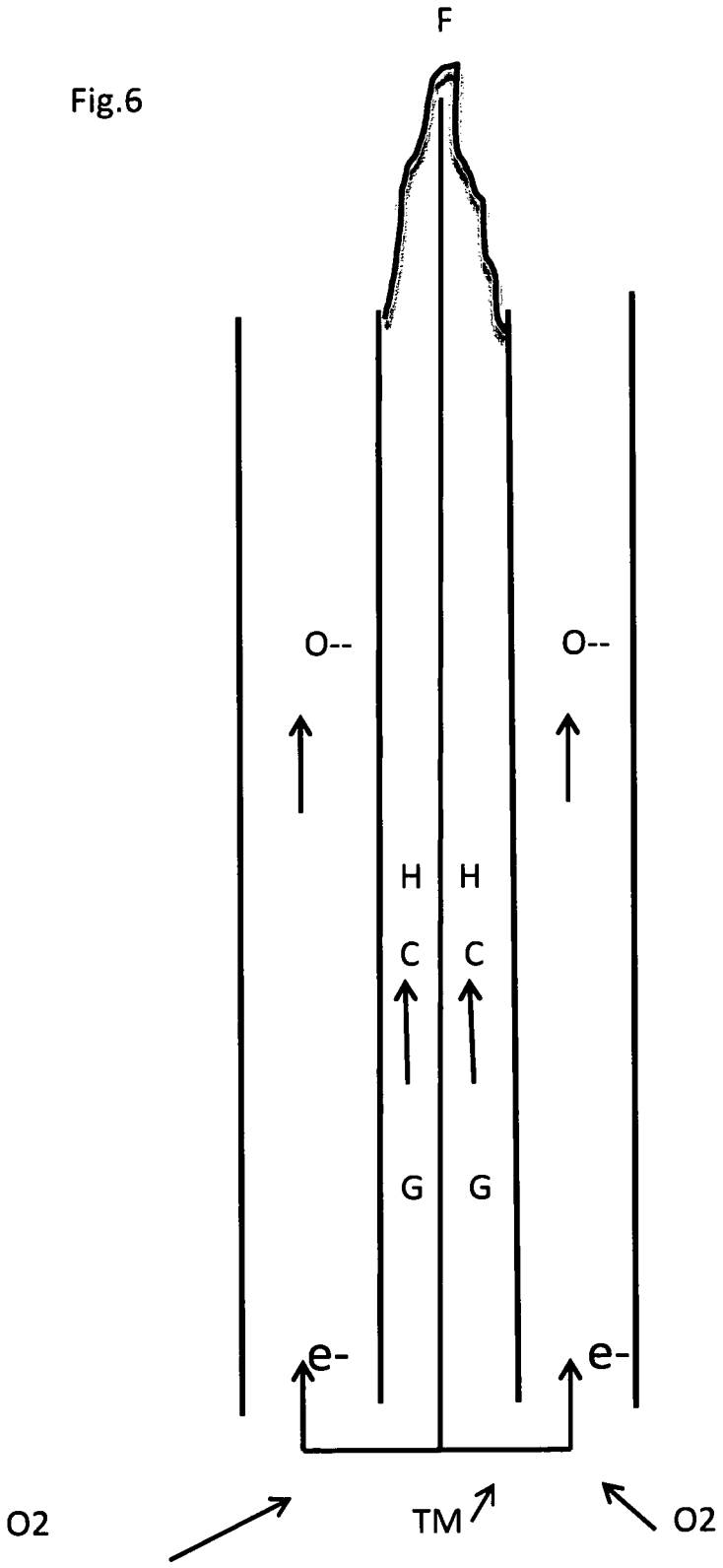

FIG. 6: sectional view; section passing by the axis.

This device is for gaseous fuels. The figure represents two tubes; one conducting the gas (G) with the metallic part at its center (TM on the drawing) and the second tube wrapping the first with the oxygen circulating in it. The electrons are caught near the flame and ejected at the entrance of the oxygen (see bottom of the drawing where e− is indicated). The two tubes are in non-conductive material of the electricity to avoid the loss of electrons.

DRAWINGS

Explanations of the text in the figures:

B: brick C: fuel (Carbon/hydrogen) CO2: carbon dioxide e−: electron F: flame G: gas H2O: water H: hydrogen L: liquid fuel O−−: oxygen ion O2: oxygen TM: metal LA, LB, LC (FIG. 1A): levels Level LC: level where, by tip effect, the electrons are ejected on entering oxygen.

DETAILED DESCRIPTION OF THE INVENTION

At the beginning of the combustion, electrons and cations (carbon; hydrogen) are released from the base fuel. The atoms of oxygen in the surroundings catch the electrons, become oxygen anions thus negative and then are attracted by the positive cations (carbon; hydrogen). The shock gives the energy. The problem is that there could be recombinations between the cations and the electrons continuously produced. The effects of these recombinations are easy to understand: less shocks and less violent shocks because a shock between a C++ and an O− is less violent than a shock between a C++++ and an O−.

The power depends on the tension between the atoms. High voltage gives high energy during the shock.

So the idea was to separate the electrons and the cations (carbon; hydrogen) when they are just produced during the first step of the combustion.

For instance, if you put a metallic part near the combustion; this metallic piece is long enough to have one end near the flames (the hot end) and the other end at the entrance of the oxygen (the cold end). Naturally, the electrons from the hot side of the part will move to the cold side, creating a positive pole near the flames and thus attracting the electrons produced by the fuel in combustion. These electrons also move to the cold side of the metallic piece where they are ejected, by tip effect, on the entering oxygen. This oxygen (O2) becomes anion (O−−) and is injected in the combustion chamber. So the free average route of the O−− is greater before the shock. There are more shocks because there are less recombinations. So energy produced is greater. These are the principles of the invention.

All the drawings given in this patent are variants of the use of metallic pieces.

The invention claimed is:

1. A method of increase combustion efficiency comprising of:

installing metal parts in a burner or a combustion chamber, having one hot end in the vicinity of the flames and a cold end at the air or oxygen entrance;

the cold end elects electrons into the oxygen or air entrance by tips effect; the hot end is at a higher level than the cold end ensuring the temperature difference.

* * * * *